United States Patent [19]

Detjen

[11] 4,009,632

[45] Mar. 1, 1977

[54] SAWMILL LOG-HANDLING SYSTEM

[75] Inventor: Robert K. Detjen, Eau Claire, Wis.

[73] Assignee: McDonough Manufacturing Company, Eau Claire, Wis.

[22] Filed: Mar. 10, 1975

[21] Appl. No.: 556,836

[52] U.S. Cl. ..... 83/731; 144/32 R; 83/435.2; 198/604; 144/245 A; 144/242 D

[51] Int. Cl.[2] ..... B27B 15/08; B27B 1/00

[58] Field of Search ..... 83/731, 424, 425, 425.2, 83/435.2; 144/245 A, 242 D, 312; 198/23, 34, 164, 162

[56] References Cited

UNITED STATES PATENTS

| | | | |
|---|---|---|---|
| 2,332,654 | 10/1943 | Mead et al. | 198/164 X |
| 2,964,074 | 12/1960 | Brown | 83/435.2 |
| 3,180,377 | 4/1965 | Pinder | 83/731 |
| 3,587,684 | 6/1971 | Bush | 144/208 E |
| 3,731,578 | 5/1973 | Ackerfeldt | 83/731 |

*Primary Examiner*—Donald R. Schran
*Attorney, Agent, or Firm*—Beveridge, DeGrandi, Kline & Lunsford

[57] ABSTRACT

Logs are advanced through a saw while they are engaged between driven pusher dogs and retarded hold-back dogs. The pusher dogs are mounted on a lower endless roller chain below the logs, and the hold-back dogs are on an upper endless roller chain above the logs. The upper chain and its hold-back dogs are vertically movable to elevations dependent on the elevation of a log, thus assuring proper engagement. When the sawed portion of a log is retained laterally on a support, the hold-back dogs are moved forwardly away from the log so that a hold-back dog will be in the path of the next log to be handled by the system.

17 Claims, 4 Drawing Figures

SAWMILL LOG-HANDLING SYSTEM

This invention relates to sawmill apparatus and methods, and particularly to a log handling system which engages and advances logs accurately through a saw, even in instances where the logs are of irregular sizes and shapes.

In one prior art system, known as a skrag saw, a log is balanced on a narrow chain carrier provided with pusher dogs which push the logs through circular saws or opposed band saws. On the outfeed side of the saws, upright guides called "splitters" are positioned in the cut made by the saw blade. The inaccuracies inherent in such systems restrict their practical use, where accuracy is important, to the sawing of small short logs of essentially cylindrical characteristics.

It has been recognized heretofore that logs of varying lengths may be accurately sawed by engaging their opposite ends by members which apply a gripping force thereto. U.S. Pat. Nos. 3,503,428 and 3,731,578 to Bo Ingemar Ackerfeldt disclose this general concept in highly complicated systems which are far more complex and expensive than the present invention. Ackerfeldt suspends his forward and rear log-engaging means from a common overhead track; both log-engaging means are coupled to and disengagable from a common drive cable; and, a spring is used to apply a gripping force between the log-engaging means.

The present invention represents a significant advance over the prior art systems described above. Unlike the prior skrag saws, logs of irregular shapes may be sawed accurately, and the necessity for the often-troublesome splitters is avoided. It is superior to the Ackerfeldt system due to its relative simplicity which makes the apparatus more compact, simpler to operate, less expensive to manufacture and sell, and thus more accessible to the small or medium sized sawmill operator.

One object of the invention is to hold logs under positive control during sawing, thus providing a degree of safety and accuracy which cannot be attained in systems where logs are held precariously.

Another object of the invention is to provide a system capable of handling rough, mis-shapen logs which cannot be fed through many existing systems due to their limb or knot projections, crooks, sweep, swell, rotten hearts, angled or splintered ends and other flaws.

Still another object of the invention is to produce completely accurate products, usually flitches, to provide a maximum recovery of lumber even from poor quality logs.

A further object of the invention is to provide a system which may handle a random mix and sequence of logs of varying lengths and diameters.

Another object is to provide a system which is relatively uncomplicated so that it may be manufactured and sold at moderate prices, thus making it available to a large variety of sawmill operators.

Another object is to provide a system which is extemely compact and does not require an excessive amount of mill space.

Other objects of the invention are to provide a system which is extremely fast due to its avoidance of the necessity of troublesome components such as splitters or chipper heads; to provide a system capable of handling hard wood, soft wood or frozen stock; and, to provide a system which is due to its relative simplicity and automatic features does not require an experienced operator.

Various ones of the preceding objects of the invention are attributable to one or more of the inventive concepts utilized in the preferred embodiment of the invention disclosed in this specification.

One of the inventive concepts relates to the use of a driven log-engaging means operable on the rear or trailing end of a log, together with a forward log-engaging means which engages the forward or leading end of a log and is supported on a chain or other endless carrier positioned above the path of the log. Another inventive concept involves the use of a driven rear log-engaging means, and a forward log-engaging means which has its movement retarded as a log is advanced through a saw, whereby the log is grasped during sawing between the driven rear log-engaging means and the retarded forward log-engaing means.

Still another inventive concept pertains to the arrangement which advances the forward log-engaging means away from the log after the sawed log is held on its support by a stabilizer means. A further inventive concept is directed to a vertically adjustable forward log-engaging means which is moved vertically in response to signals from a sensor for detecting the elevation of the forward end of a log.

A typical preferred system embodying all of the inventive concepts is disclosed in the accompanying drawings wherein.

Throughout the drawings, a twin bandsaw assembly is shown in diagramatic form having a pair of saw bands 2 and 4 supported on their respective wheels or pulleys 6, 8, 10 and 12. Means are provided for rotating the wheels in a conventional manner to cause the bandsaws to cut a log which is advanced longitudinally therethrough, the sides of the log being cut by the adjacent vertical portions of the saw bands 2 and 4. This normally produces two slabs and a center heart piece which is known in the art as a flitch or cant. The saws are preferably shifting saws for producing a heart piece of a thickness ranging from about four inches to any larger size which may be accommodated by secondary reduction resaws available at the mill. Of course, any number of saw blades of the band or rotary type may be used within the context of this invention.

A pair of known driven jump turning rolls 14 and 16 are provided at the infeed side of the saw blades 2 and 4. These rolls 14 and 16 are used to support and orient a log prior to sawing. They have spaced full length guide bars to promote engagement with a log and they are rotatable about their longitudinal axes by a hydraulic motor so as to position a log preliminarily at a desired orientation. The rolls 14 and 16 are vertically movable which permits them to be elevated to raise a log above the path of the pusher dogs described below.

Figure 1:
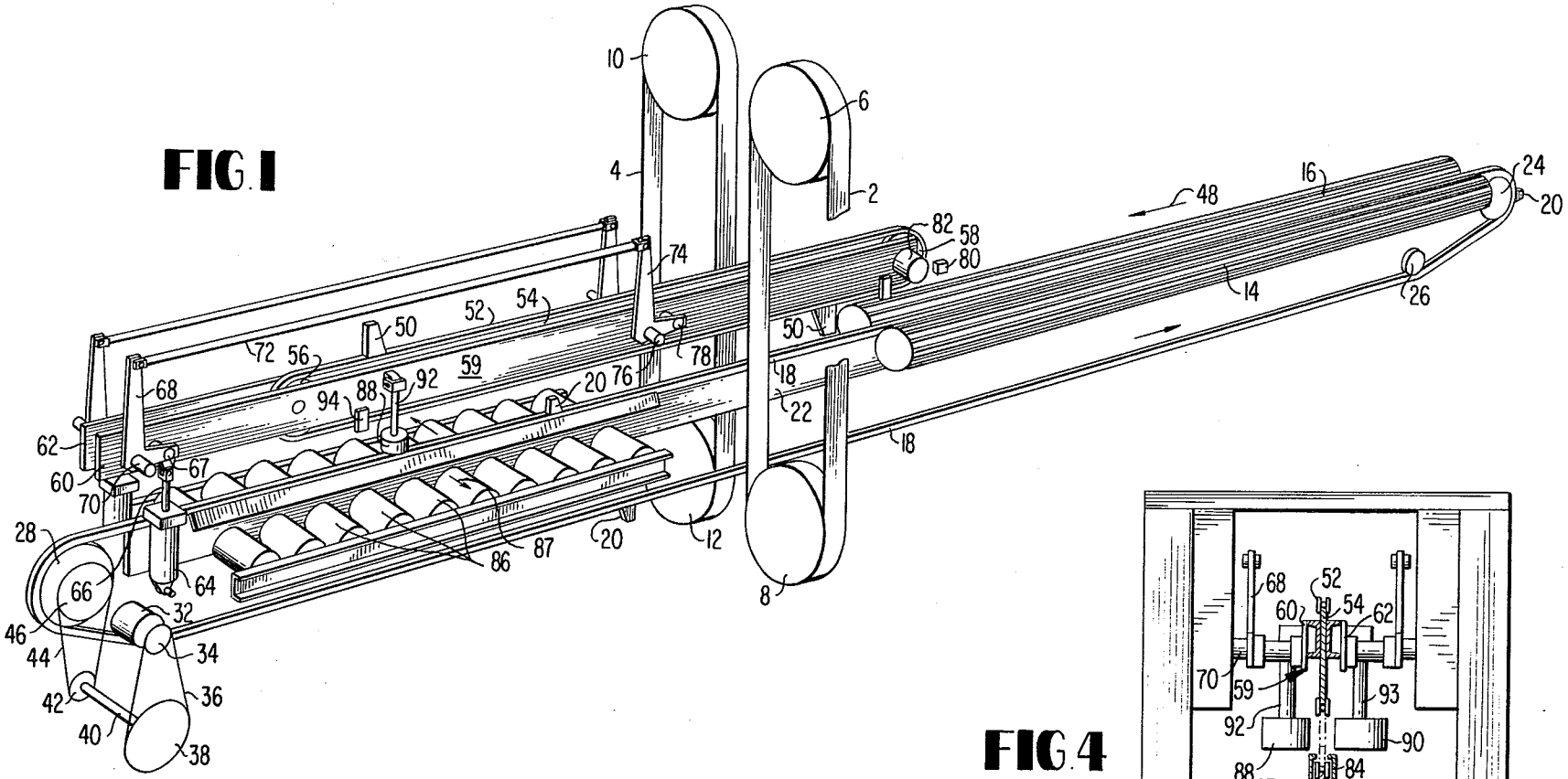
FIG. 1 is a perspective view, diagramatic in some respects, of the log handling system of the invention.
Figure 2:
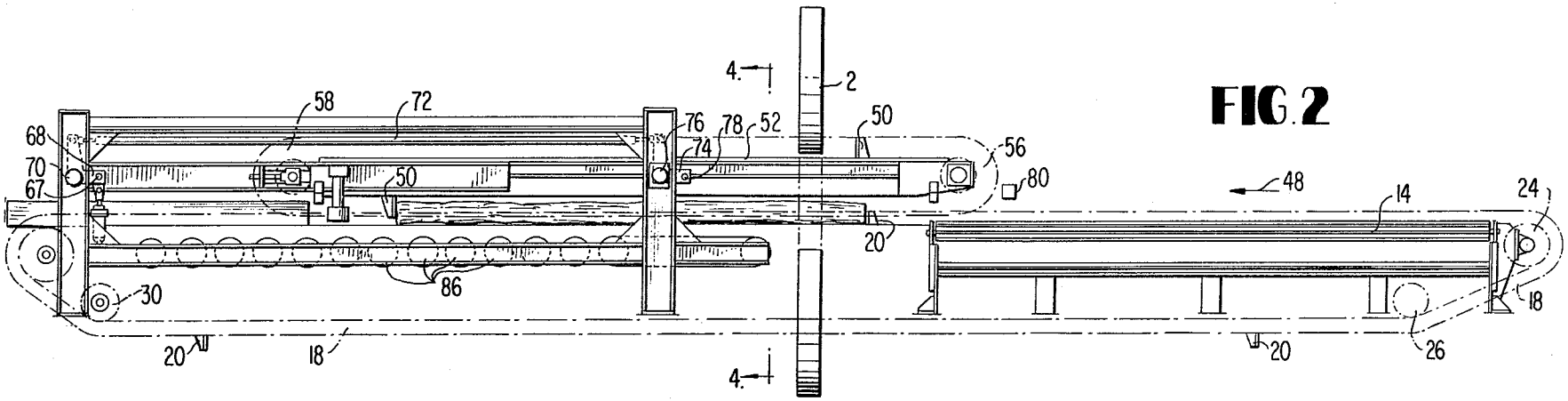
FIG. 2 is a side elevation of the system of FIG. 1.
Figure 3:
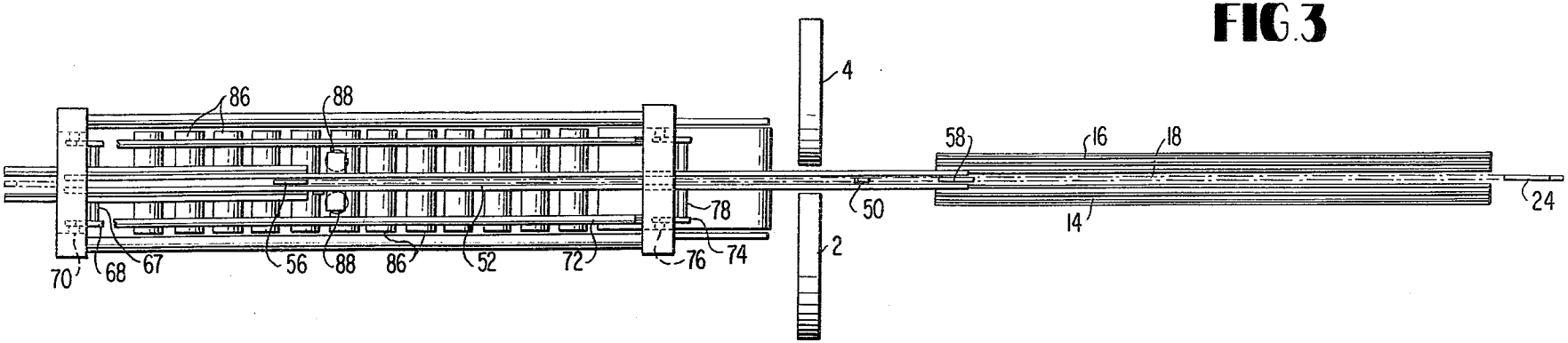
FIG. 3 is a plan view of the log handling system of FIG. 1.

As seen in FIG. 3, the log turning rolls 14 and 16 are spaced apart to accommodate therebetween an endless roller chain 18 which is positioned below the path followed by logs in the apparatus. This chain 18 serves as a lower carrier for supporting a series of rear log engaging means such as the pusher dogs illustrated at 20. The upper horizontal run of the chain 18 rides on a guide rail 22 and the chain is engaged on a series of sprockets 24, 26, 28 and 30, the latter being shown only in FIG. 2. The lower horizontal run of the chain extends between the pulleys 26 and 30 and the chain is moved in a continuous path on its sprockets and guide rail 22 by a drive means including the hydraulic fluid motor 32. The sprocket 34 of hydraulic motor 32 is engaged with the chain 18 by a reduction system illustrated in FIG. 1 and including the chain 36, enlarged sprocket 38, shaft 40, reduced sprocket 42, chain 44 and the sprocket 46 which is coupled directly to the sprocket 28 for the chain 18. Operation of the hydraulic motor 32 drives the chain 18 and its pusher dogs 20 in a counterclockwise direction as seen in FIGS. 1 and 2, thus causing the pusher dogs 20 to engage the rear end of a log and propel the log along a given path in the direction indicated by the arrow 48. This carries the log through the saw and to the outfeed side of the saw.

Figure 4:
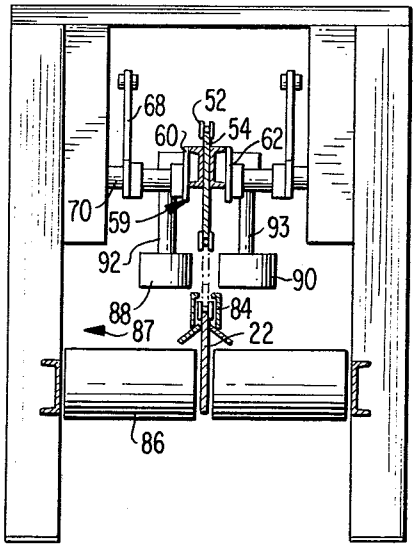
FIG. 4 is a sectional view thereof as seen along the line 4—4 in FIG. 2.

Prior to movement of a log into the saw bands 2 and 4, its forward end is engaged by a hold-back dog 50 which serves as the forward log-engaging means of the apparatus. Dogs 50 are supported on an upper roller chain 52 which is continuous and moves in an endless path on the guide rail 54 and sprockets 56 and 58. These sprockets 56 and 58 are rotatably supported on an upper frame 59 formed of a pair of elongated parallel plates 60 and 62 which are spaced apart to support the guide rail 54 as shown in FIG. 4. The upper frame 59 is vertically movable to permit the dogs 50 to engage the upper part of the forward end of a log at an appropriate elevation. This vertical movement is produced by a hydraulic cylinder 64 which has its plunger rod 66 connected at 67 to the frame 59 and to a horizontal leg of a bellcrank lever 68 which is pivotally mounted on the rotatable stationary pivot axle 70. The vertical arm of the bellcrank lever 68 is pivotally connected to an elongated link 72, the opposite end of which is connected to the upper end of a similar leg of a bellcrank lever 74, the latter being supported on a stationary pivot axle 76 and being connected to the frame at 78, thus causing the portion of the frame in the vicinity of the saws to move vertically the same distance as the frame in the vicinity of the hydraulic cylinder 64. It will be observed that an identical arrangement including an hydraulic cylinder and bellcrank linkages is provided on both sides of the frame 59 which supports the chain 52 and its hold-back dogs 50.

The operation of the hydraulic cylinders 64 may be performed by a machine operator who observes the elevation of the forward end of a log being fed toward the saw by the rear pusher dogs 20. However, this change in elevation may be performed automatically by providing a limit switch 80 at a location prior to a point where the forward end of a log comes into contact with a hold-back dog 50. The actuator of limit switch 80 will be contacted by a log of large diameter, thus sensing the elevation of a forward end of a log prior to engagement of the log with the hold-back dogs 50. Actuation of the limit switch 80 will automatically operate hydraulic cylinder 64 to elevate the frame 59, thus moving the chain 52 and dogs 50 to an appropriate height.

During the sawing operation, firm engagement of the hold-back dogs 50 with the log is assured by retarding the movement of the dogs 50 as the log is advanced through the saw by the drive means for the pusher dogs, thus causing the log to be grasped between the pusher dog 20 and the hold-back dogs 50. The retardation of the hold-back dogs 50 is achieved by resistance means which includes the friction of the means for supporting and engaging the chain 52, and also the deactivated hydraulic fluid motor 82 which is coupled to the sprocket 58. Actually, the motor 82 will be connected to the sprocket 58 by a reduction means similar to that used for driving the lower chain 18 with the motor 32, but this construction has been eliminated from the drawings for purposes of clarity. Retardation of the hold-back dogs may also be produced by a brake on one of the sprocket shafts for chain 52. Initial engagement of the hold-back dog 50 with the log may be achieved by momentarily reversing the motor 82.

The motor 82 also serves as a drive means for moving the hold-back dog 50 forwardly at or toward the conclusion of the saw operation. At this point, the log will be supported on a rail 84 shown best in FIG. 4. Upon completion of sawing, the slabs will fall onto the conventional screw rolls 86 which are provided with helical ribs (not shown) and are rotated about their axes to move the slabs in the directions indicated by the arrows 87. The flitch or cant is held or retained on the upper edge of the rail 84 by the rolls 88 and 90 which are stabilizer means for retaining the log on the log support rail 84 to prevent lateral displacement of the logs after sawing. The rolls 88 and 90 are supported by vertical shafts 92 and 93, the upper ends of which are pivotally mounted for lateral swinging movement.

Of course, once the log is engaged by the stabilizer rolls 88 and 90, the hold-back dogs 50 are no longer required. As these dogs 50 arrive at and engage the limit switch 94, a circuit is actuated to energize the hydraulic motor 82 for the upper chain 52. The hydraulic motor 82 drives the chain 52, moving the dogs 50 forwardly away from the log when the log is retained by the stabilizer rolls 88 and 90. The hydraulic motor 82 is deactivated when one of the hold-back dogs 50 arrives at and trips the limit switch 96 positioned at the rear end of the upper frame 59. This deactivates the hydraulic motor 82, and stops movement of the upper carrier chain 52 at a point when one of the hold-back dogs 50 is positioned in the path for engaging the forward end of the next log to be moved through the apparatus.

The operation of this apparatus will be evident from the preceding description. A log is fed to the turning rolls 14 and 16 by a conventional log deck which has a log stop and loader. The rolls 14 and 16 are rotated by an hydraulic motor (not shown) to place the log at an appropriate orientation. The rolls 14 and 16 are elevated during rotation to hold the log above the path of the pusher dogs 20. When rotation is completed, the rolls are lowered to place the log in the path of pusher dog 20. Motor 32 drives chain 18 to carry one of the pusher dogs 20 into engagement with a lower part of the rear end of a log, thus moving the log toward the saw. At this stage, one of the forward hold-back dogs 50 is positioned in the path of the advancing log. Before a large log engages the dog 50, it will actuate the limit switch 80 to actuate the hydraulic cylinder 64 and raise the frame 59, chain 52 and the hold-back dog 50. The upper part of the forward end of the log then comes into engagement with the hold-back dog 50 which is prepositioned in the path of the log. The dog 50 resists movement due to the friction in its supporting and driving means and the presence of the deactivated motor 82, thus imposing on the log a rearward force which places the log under longitudinal compression and tends to clamp the log firmly between a hold-back dog 50 and a pusher dog 20. Being positively clamped in this manner, the log acts as a rigid torsional resisting beam as it is advanced through the bands 2 and 4 of the saw. As one of the two hold-back dogs 50 moves with the log, the other dog 50 is carried by chain 52 in a direction toward its log-receiving position. The sawed log is supported on the rail 84 and the slabs fall onto the screw rolls 86, to be carried under the bridge section of the outfeed system by cross transfer chains, and to a slab resaw. If a reverse even index of slabs passing to the slab resaw is desired, the screw rolls may be replaced by slab-receiving short driven belts or slat bed sections which carry the slabs to camel back chains passing under the bridge section of the outfeed system.

The stabilizer rolls 88 and 90 retain the log on the rail 84, and the forward lug 50 actuates the limit switch 94. This energizes the hydraulic motor 82 and drives the chain 52 to move the hold-back dog 50 forwardly away from the log. When one of the dogs 50 on chain 52 comes to the limit switch 96, the switch 96 is actuated to deactivate the hydraulic motor 82, thus leaving a dog 50 in a position where it may engage the next log to be handled by the system.

Those skilled in the art will realize that many of the advantageous concepts of the invention may be utilized by apparatus other than the specific embodiment disclosed herein. Various types of means may be used to support the log before and after sawing, and some aspects of the invention may be utilized without the endless chains 18 and 52 for supporting and transmitting the driving forces to the dogs 20 and 50. Vertical adjustability of the upper chain is desirable but not essential in all systems. In view of the vast possibilities of modifying the system without departing from its important inventive concepts, it is emphasized that the invention is not limited to the disclosed embodiment but encompasses other modifications and variations thereof which fall within the spirit of the following claims.

I claim:

1. A sawmill log handling system for advancing logs longitudinally along a given path from an infeed side of a saw, through the saw and to an outfeed side of the saw, said system comprising, rear log-engaging means for engaging a rearward end of a log, forward log-engaing means for engaging a forward end of said log, a lower carrier means for supporting one of said log-engaging means, said lower carrier means being positioned below the given path of the log, an upper carrier means for supporting the other said log-engaging means, said upper carrier means being an endless member movable in a continuous path and positioned above the given path of the log, rear drive means for moving a said carrier means to advance the rear log-engaging means along said given path to carry said logs from said infeed side, through the saw and to said outfeed side, said forward log engaging means engaging a forward end of said log while said log is being moved by said rear drive means, said forward log-engaging means being movable from the infeed side to the outfeed side as the log is cut by the saw, and, forward drive motor means for moving said carrier means supporting the forward log-engaging means to drive the forward log engaging means forwardly away from the log after the log has passed through the saw.

2. The sawmill log handling system of claim 1 wherein said lower carrier means is an endless member movable in a continuous path, both of said endless members include two horizontal runs which are positioned vertically with respect to each other.

3. The sawmill log handling system of claim 2 wherein both of said endless member are chains.

4. The sawmill log handling system of claim 1 including a resistance means for retarding movement of the forward log-engaging means as the log is advanced through the saw by the drive means, whereby said log is grasped between the driven said rear log-engaging means and the retarded said forward log-engaging means.

5. The sawmill log handling system of claim 1 having a log support means for underlying and supporting a log on the outfeed side of the saw, stabilizing means for retaining said log on the log support means to prevent lateral displacement of the log after sawing.

6. The sawmill log handling system of claim 5 provided with means for stopping the movement of the carrier means supporting the forward log-engaging means when a forward log-engaging means thereon is positioned in the path for engaging the forward end of the next log to be moved through the saw by the system.

7. The sawmill log handling system of claim 1 having sensor means for sensing the elevation of the forward end of a log prior to its engagement with said forward log-engaging means, and means for moving the forward log-engaging means vertically in response to the elevation sensed by said sensor means.

8. The sawmill log handling system of claim 7 having a vertically movable upper frame supporting the forward log engaging means, and having bellcrank lever means for moving the upper frame vertically.

9. A sawmill log handling system for advancing logs longitudinally along a given path from an infeed side of a saw, through the saw and to an outfeed side of the saw, said system comprising, rear log-engaging means for engaging a rearward end of a log, rear drive means for moving said rear log-engaging means along said given path to carry said logs from said infeed side, through the saw and to said outfeed side, forward log-engaging means for engaging a forward end of said log while said log is being moved by said rear drive means, said forward log-engaging means being movable from the infeed side to the outfeed side as the log is cut by the saw, a deactivated hydraulic motor coupled to said forward log-engaging means for retarding movement of the forward log-engaging means as the log is advanced through the saw by the drive means, whereby said log is grasped between the driven said rear log-engaging means and the retarded said forward log-engaging means.

10. The sawmill log handling system of claim 9 having a log support means for underlying and supporting a log on the outfeed side of the saw, stabilizing means for retaining said log on the log support means to prevent lateral displacement of the log after sawing, and means for activating the hydraulic motor to advance the forward log-engaging means forwardly from the log when the log is retained by the stabilizer means.

11. The sawmill log handling system of claim 10 having an endless upper carrier means which carries the forward log-engaging means, and means for stopping the movement of the upper carrier means when an upper log-engaging member thereon is positioned in the path for engaging the forward end of the next log to be moved through the saw by the system.

12. The sawmill log handling system of claim 11 having sensor means for sensing the elevation of the forward end of a log prior to its engagement with said forward log-engaging means, and means for moving the forward log-engaging means vertically in response to the elevation sensed by said sensor means.

13. The sawmill log handling system of claim 12 having spaced apart bellcrank means supporting said log engaging means.

14. A sawmill log handling system for advancing logs longitudinally along a given path from an infeed side of a saw, through the saw and to an outfeed of the saw, said system comprising, rear log-engaging means for engaging a rearward end of a log, rear drive means for moving said rear log-engaging means along said given path to carry said logs from said infeed side, through the saw and to said outfeed side, forward log-engaging means for engaging a forward end of said log while said log is being moved by said rear drive means, said forward log-engaging means being movable from the infeed side to the outfeed side as the log it cut by the saw, a log support means for underlying and supporting a log on the outfeed side of the saw, stabilizing means for retaining said log on the log support means to prevent lateral displacement of the log after sawing, and a forward drive motor means for advancing the forward log-engaging means to accellerate it forwardly from the log when the log is retained by the stabilizing means.

15. The sawmill log handling system of claim 14 having an endless upper carrier means for supporting the forward log-engaging means, means for stopping the movement of the upper carrier means when an upper log-engaging member thereon is positioned in the path for engaging the forward end of the next log to be moved through the saw by the system.

16. A sawmill log handling system for advancing logs longitudinally along a given path from an infeed side of a saw, through the saw and to an outfeed side of the saw, said system comprising, rear log-engaging means for engaging a rearward end of a log, rear drive means for moving said rear log-engaging means along said given path to carry said logs from said infeed side, through the saw and to said outfeed side, forward log-engaging means for engaging a forward end of said log while said log is being moved by said rear drive means, said forward log-engaging means being movable from the infeed side to the outfeed side as the log is cut by the saw, sensor means for sensing the elevation of the forward end of a log prior to its engagement with said forward log-engaging means, and means for moving the forward log-engaging means vertically in response to the elevation sensed by said sensor means.

17. The sawmill log handling system of claim 16 having an upper frame located above said path, said forward log engaging means being supported on said upper frame, and spaced apart bellcrank means for moving the upper frame vertically.

* * * * *